US007505724B2

(12) United States Patent
Nakayama

(10) Patent No.: US 7,505,724 B2
(45) Date of Patent: Mar. 17, 2009

(54) ENDLESS BELT TYPE IMAGE HEATING DEVICE WITH ROCKING MEMBER AND LUBRICATING APPLICATION

(75) Inventor: Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 438 days.

(21) Appl. No.: 11/408,931

(22) Filed: Apr. 24, 2006

(65) Prior Publication Data

US 2006/0245798 A1 Nov. 2, 2006

(30) Foreign Application Priority Data

May 2, 2005 (JP) ..... 2005-134115

(51) Int. Cl.
*G03G 15/20* (2006.01)

(52) U.S. Cl. ..... 399/329; 399/325; 399/327

(58) Field of Classification Search ..... 399/329, 399/325, 327

See application file for complete search history.

(56) References Cited

U.S. PATENT DOCUMENTS

2005/0220506 A1 10/2005 Nakayama ..... 399/323
2006/0133836 A1 6/2006 Nakayama ..... 399/68

FOREIGN PATENT DOCUMENTS

| | | | |
|---|---|---|---|
| JP | 9-34291 | | 2/1997 |
| JP | 11-24458 | | 1/1999 |
| JP | 11-45018 | | 2/1999 |
| JP | 2004212844 A | * | 7/2004 |
| JP | 2005062568 A | * | 3/2005 |

* cited by examiner

*Primary Examiner*—David M Gray
*Assistant Examiner*—Erika Villaluna
(74) *Attorney, Agent, or Firm*—Fitzpatrick, Cella, Harper & Scinto

(57) ABSTRACT

An image heating device has a heating roller, an endless belt forming a nip with the heating roller and a pressure pad pressing the belt into the nip, the device has a supplying and connection unit to supply a lubricant onto the inner surface of a pressure belt before the pressure pad and to collect the supplied lubricant from the pressure belt before a steering roller.

4 Claims, 4 Drawing Sheets

ENDLESS BELT TYPE IMAGE HEATING DEVICE WITH ROCKING MEMBER AND LUBRICATING APPLICATION

BACKGROUND OF THE INVENTION

1. Field of the Invention

The present invention relates to an image heating device configured to heat an image on a recording material. As examples of such image heating device, there are fixing devices used in copying machines, printers, and facsimile machines employing electrophotographic recording methods or electrostatic recording methods, as well as glossiness increasing devices for increasing glossiness of the image.

2. Description of the Related Art

In conventional fixing devices used in electrophotographic image forming devices, a heat roller fixing method which uses a pair of rollers for heating and pressing is often employed. In recent years, in order to accommodate higher-speed image forming, a belt fixing device employing a belt for heating or pressing has been proposed. For example, in the belt fixing device discussed in Japanese Patent Application Laid-open No. 9-034291, pressure is applied from the inner surface of a belt by using a pressure pad in order to increase the width of a fixing nip. Japanese Patent Application Laid-open No. 11-045018 discusses a belt fixing device in which oil is applied onto the inner surface of a belt in order to decrease sliding friction between the pressure pad and the inner surface of the belt.

Further, Japanese Patent Application Laid-open No. 11-024458 discusses a belt fixing device in which rocking control is performed in a direction of the belt's width by repeatedly displacing a steering roller which suspends the belt.

However, in the above-mentioned conventional art, there are problems described below.

That is, if oil supply is increased for a lengthened time in order to decrease sliding friction between the pressure pad and the belt, a large amount of oil may adhere to the steering roller, and it may be difficult for the belt to follow the displacement of the steering roller. As a result, the control of rocking of the belt may not be appropriately performed.

SUMMARY OF THE INVENTION

One aspect of the present invention is directed to an image heating device having a heating rotator configured to heat an image on a recording material at a nip portion, an endless belt configured to form the nip portion with the heating rotator, a pressure pad configured to press the belt at the nip portion in a direction toward the heating rotator, a rocking member configured to contact with the inner surface of the belt so as to rock the belt in a widthwise direction of the belt, a supplying unit configured to supply a lubricant onto the inner surface of the belt at a position downstream of the rocking member and upstream of the pressure pad in a rotating direction of the belt, and, a collection unit configured to collect the lubricant of the inner surface of the belt at a position downstream of the pressure pad and upstream of the rocking member in the rotating direction of the belt.

Further exemplary embodiments, aspects and features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate numerous exemplary embodiments, features and aspects of the invention and, together with the description, serve to explain the principles of the invention.

DETAILED DESCRIPTION OF THE EXEMPLARY EMBODIMENTS

Various exemplary embodiments, features and aspects of the present invention will now be herein described in detail below with reference to the drawings. However, it is to be understood that the scope of the invention is not intended to restrict the sizes, materials, shapes, relative arrangements, or the like of constituent parts described in the following exemplary embodiments unless expressly noted. Also, the materials, shapes, or the like of members once described in the following description, unless newly expressly noted, are similar to those described at first.

Figure 1:
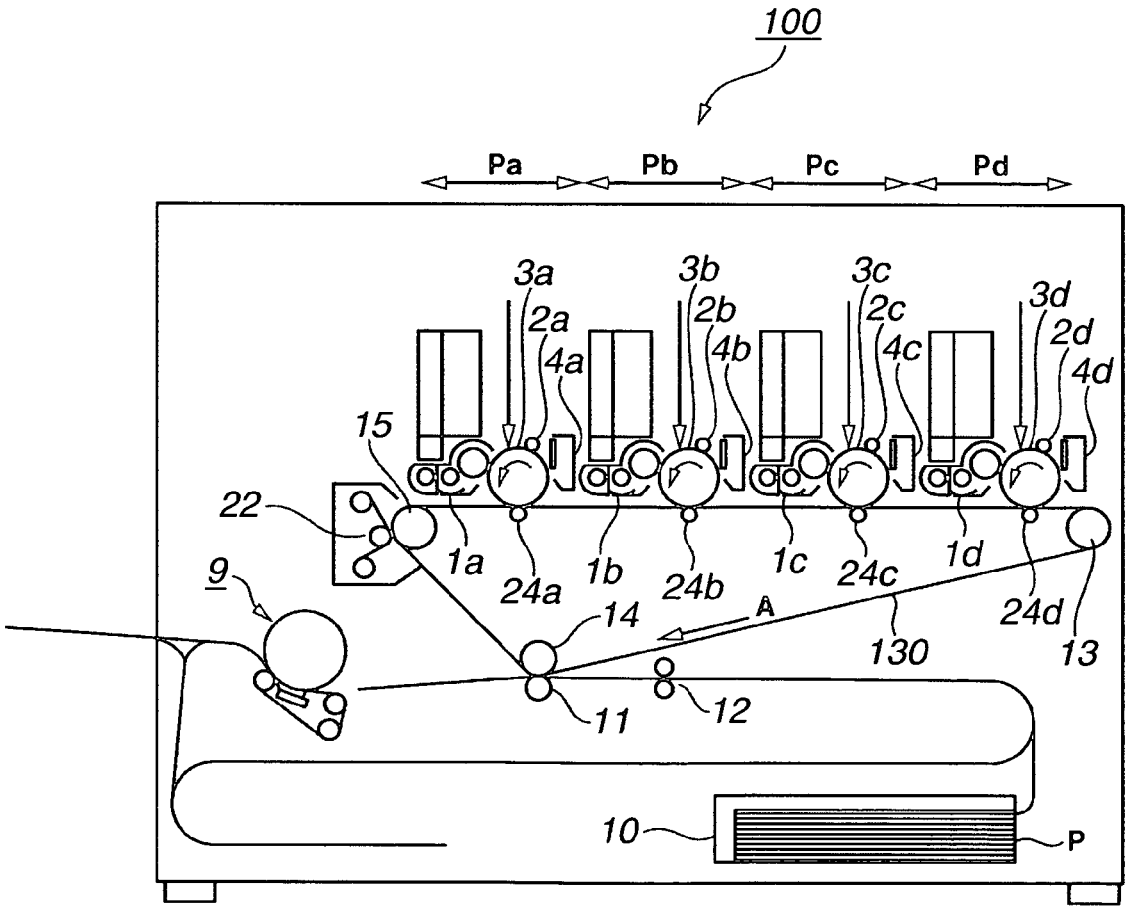
FIG. 1 illustrates a cross-sectional view of an image forming apparatus according to an exemplary embodiment of the present invention.

FIG. 1 illustrates a cross-sectional view of an image forming apparatus according to an exemplary embodiment of the present invention. Within an image forming apparatus 100 shown in FIG. 1, a first image forming part Pa, a second image forming part Pb, a third image forming part Pc, and a fourth image forming part Pd are provided side by side. At each part, a differently colored toner image is formed through processes of latent image formation, development, and transfer.

The image forming parts Pa, Pb, Pc, and Pd each includes a dedicated image carrier. In the case of the exemplary embodiment, the image carriers are electrophotographic photosensitive drums 3*a*, 3*b*, 3*c*, and 3*d*. On each photosensitive drum 3*a*, 3*b*, 3*c*, and 3*d*, a color toner image is formed. An intermediate transferring member 130 is provided adjacent to each photosensitive drum 3*a*, 3*b*, 3*c*, and 3*d*. In a process of a primary transfer, the toner image of each color formed on the photosensitive drums 3*a*, 3*b*, 3*c*, and 3*d* is transferred onto the intermediate transferring member 130 and then, a secondary transfer onto a recording material P is performed. Further, the recording material P on which the toner images are transferred is heated and pressed in a fixing device 9. The fixing device 9 is an image heating device that fixes the toner images. After fixing is performed, the recording material P is discharged to the outside of the device as a recorded image.

On the outer circumference of the photosensitive drums 3*a*, 3*b*, 3*c*, and 3*d*, drum chargers 2*a*, 2*b*, 2*c*, and 2*d*, developing devices 1*a*, 1*b*, 1*c*, and 1*d*, primary transfer chargers 24*a*, 24*b*, 24*c*, and 24*d*, and cleaners 4*a*, 4*b*, 4*c*, and 4*d* are provided. At an upper portion of the device, a light source and a polygon mirror (not shown) are provided.

Latent images are formed according to image signals on the photosensitive drums 3*a*, 3*b*, 3*c*, and 3*d* in a following manner. The polygon mirror is rotated and scanning laser beam is emitted from the light source. The flux of the scanning light is deflected by a reflex mirror, and the flux of scanning light is condensed and applied onto the generating line of the photosensitive drums 3*a*, 3*b*, 3*c*, and 3*d* by an fθ lens. Thus, latent images are formed.

The developing devices 1*a*, 1*b*, 1*c*, and 1*d* are filled respectively with an adequate amount of toner (i.e., developer) of cyan, magenta, yellow, and black by a supply device (not shown). The developing devices 1*a*, 1*b*, 1*c*, and 1*d* develop the latent images on the photosensitive drums 3*a*, 3*b*, 3*c*, and 3*d* respectively, and visualize the latent images as a cyan toner image, a magenta toner image, a yellow toner image, and a black toner image.

The intermediate transferring member 130 is rotationally driven at a peripheral velocity the same as the photosensitive drums 3*a*, 3*b*, 3*c*, and 3*d* in the direction indicated by the arrow A, being suspended by rotating rollers 13, 14, and 15.

The above yellow toner image of a first color that is formed on and carried by the photosensitive drum 3*a* passes through a nip portion between the photosensitive drum 3*a* and the intermediate transferring member 130. During the process of passing through the nip portion, the yellow toner image is transferred onto the outer circumference of the intermediate transferring member 130 by an electric field and pressure generated by a primary transfer bias applied to the intermediate transferring member 130.

The above process is also sequentially performed to the magenta toner image of a second color, the cyan toner image of a third color, and the black toner image of a fourth color, and a superimposed transfer image is formed on the intermediate transferring member 130. Thus, a synthetic color toner image corresponding to an object color image is formed.

A secondary transfer roller 11 is supported in parallel to the intermediate transferring member 130 and is arranged in contact with the under surface of the intermediate transferring member 130. To the secondary transfer roller 11, a desirable secondary bias is applied by a secondary transfer bias source.

The synthetic color toner image, superimposed and transferred onto the intermediate transferring member 130, is transferred onto the recording material P in a following manner. The recording material P is supplied from a feed cassette 10 through registration rollers 12 and pre-transfer guide, to a contact nip between the intermediate transferring member 130 and the secondary transfer roller 11 at a predetermined timing. At the same time, a secondary transfer bias is applied to the intermediate transferring member 130 from a bias source. Under the action of the secondary transfer bias, the synthetic color toner image is transferred from the intermediate transferring member 130 to the recording material P.

Meanwhile, after the primary transfer is completed, residual toner on the photosensitive drums 3*a*, 3*b*, 3*c*, and 3*d* is cleaned and removed by the dedicated cleaners 4*a*, 4*b*, 4*c*, and 4*d*, respectively. Then, the photosensitive drums 3*a*, 3*b*, 3*c*, and 3*d* stand by for the next forming of a latent image. Residual toner and the other foreign materials are wiped off the intermediate transferring member 130 by bringing a cleaning web (nonwoven web) 22 into contact with the surface of the intermediate transferring member 130 after the toner image is transferred to the recording material P.

The recording material P on which the toner image is transferred, is sequentially conveyed to a fixing device 9, which will be described below. Then, heat and pressure is applied to the recording material P, and the toner image is fixed.

Figure 2:
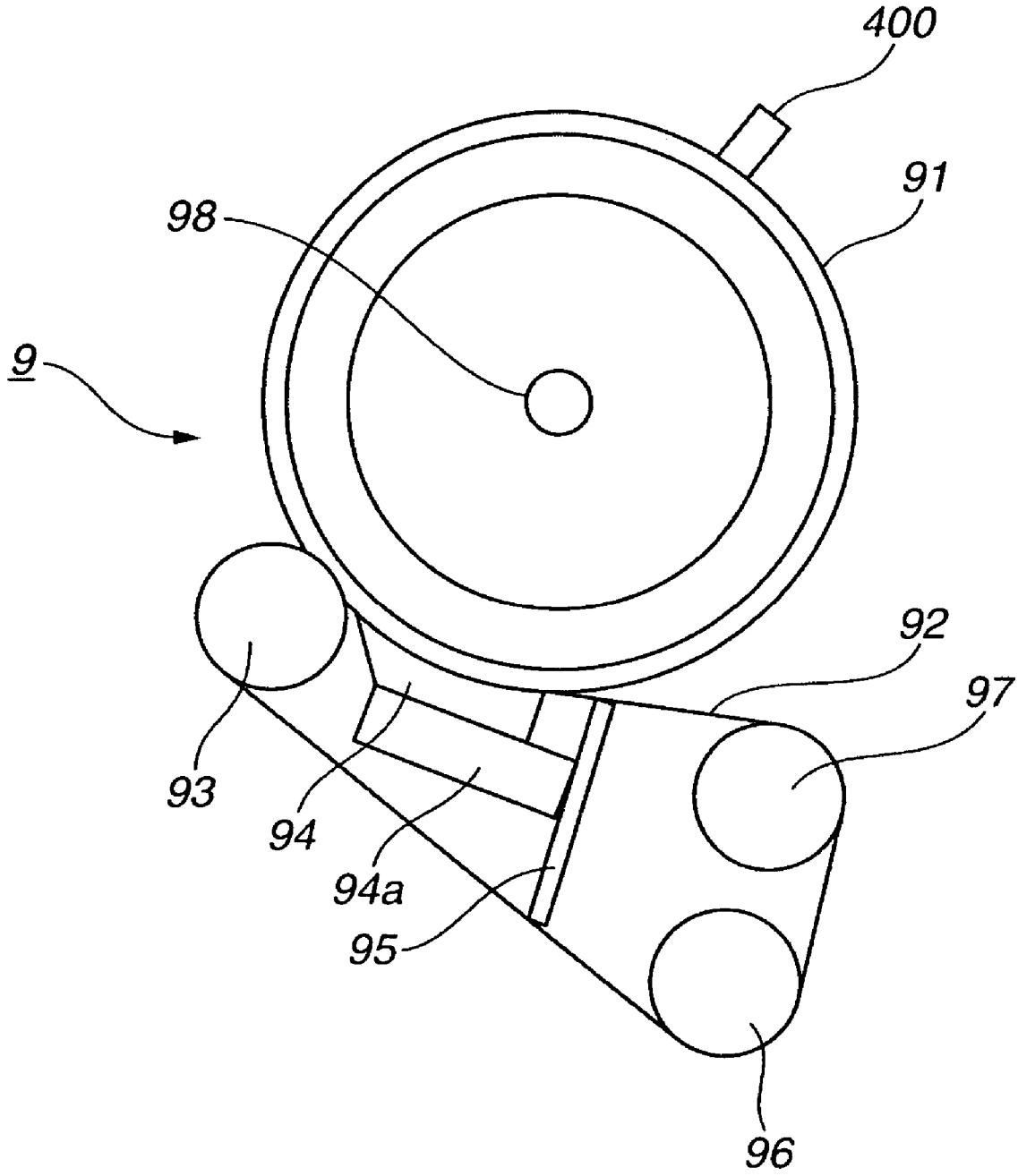
FIG. 2 illustrates a cross-sectional view of a fixing device according to an exemplary embodiment of the present invention.

FIG. 2 is a cross-sectional view of the main parts of the fixing device 9 used in the image forming apparatus (i.e., an image heating device) shown in FIG. 1. In the exemplary embodiment, a belt type fixing device which employs an endless belt as a pressure member (that contacts with the reverse side of a recording material) is described as an image heating device. However, it is to be understood that the present invention is not limited to the exemplary embodiment, and is also applicable to a system which employs a belt as a heating member (that contacts with the surface of a recording material).

A fixing roller 91 is a rotator having an outside diameter of 80 mm, in which a hollow core metal made of Al having an outside diameter of 77 mm is covered with a elastic layer of silicone rubber which has hardness of 20 degree (JIS-A hardness (1 kg weight)) and a thickness of 1.5 mm. Further, the surface of the elastic layer is covered with a PFA tube having an thickness of 30 to 100 μm.

In the inside of the fixing roller 91, a halogen heater 98 is provided as a heating source. Further, on the surface of the fixing roller 91, a temperature sensor 400 is provided in contact with the fixing roller 91. The temperature sensor 400 is connected to a CPU 200 (see FIG. 3), and a temperature control circuit of the CPU 200 controls passage of electrical current to the halogen heater according to an input signal (a temperature of the fixing roller) from the sensor 400. In the exemplary embodiment, the temperature of the fixing roller 91 during fixing process is controlled to remain at 180 degree.

A belt 92 having a endless shape is suspended by a plurality of rollers, and arranged to be in contact with the fixing roller 91. At the fixing nip, the inside of the belt 92 is pressed by a pressure pad 94 in a direction toward the fixing roller 91. Further, the belt 92 is suspended by a separation roller 93, steering roller 96, and a suspension roller 97 so as to retain a predetermined tension.

The belt 92 is composed of a base made of resin such as polyimide, or a metal such as Nickel, and the surface of the base is covered with an elastic body layer of silicone rubber, fluoro rubber, or the like. In addition, on the elastic body layer, a layer made of a fluoro plastic such as FRP, PFA, and PTFE, or a rubber mixing these fluoro plastics may be stacked as a toner releasing layer.

The separation roller 93 is made of metal such as Fe, SUS. The separation roller 93 is pressed so as to dig into the fixing roller 91 through the belt 92, deform the elastic layer of the fixing roller 91 and separate the recording material P from the surface of the fixing roller 91. The pressure of the separation roller is 300 N to 500 N, and a contact portion (separation nip portion) between the fixing roller 91 and the separation roller 93 is about 4 mm.

A pressure pad 94 includes an elastic body made of silicone rubber of hardness of 20 degree (JIS-A hardness (1 kg weight)) and a pad base 94*a* made of a metal on which the silicone rubber is attached. The pad base 94*a* is fixed to a side plane of a belt unit (not shown). As a result, the pressure pad 94 presses the belt toward the fixing roller at the fixing nip while also sliding in contact with the inner surface of the belt 92. Further, the pressure pad 94 includes a low-friction sheet as a low-friction sliding member for covering the surface of the silicone rubber (fixing roller side) in order to increase the slide characteristic of the pressure pad 94 in relation to the belt 92. Instead of providing the low-friction sheet, a low-friction process may be treated on the surface of the silicone rubber, specifically, a fluoro plastic may be used to coat the surface.

In the exemplary embodiment, the pressure pad 94 has a low-friction sheet (not shown) made of a glass fiber sheet (FGF-40, produced by Chukoh Chemical Industries, Ltd) on the side where the pressure pad 94 slides over the belt. That is, the pressure pad used in the exemplary embodiment has a structure in which the low-friction sheet is in sliding contact with the inner surface of the belt 92. The pressure pad 94 is pressed at a pressure of 400 N to 600 N, and the contact portion (pressure nip portion) between the fixing roller 91 and the pressure pad 94 is about 20 mm.

As described above, when a fixing nip is formed by the fixing roller 91, the belt 92, and the pressure pad 94, a wide nip can be formed as if to wrap around the outer circumference of the fixing roller 91, and thus high-speed fixation can be achieved. Further, by pressing the separation roller 93 so as to dig into the surface of the fixing roller 91, even in the high-speed fixation, recording materials can achieve good separation characteristic.

In conventional fixing devices using a pair of rollers, if a width of the nip is large, the thickness of an elastic body layer has to be increased, which is disadvantageous because it increases energy consumption. On the other hand, in the fixing device using the above-described belt, a wide nip can be formed without increasing the thickness of the elastic body layer of the fixing roller 91. Accordingly, heat loss due to the elastic body layer can be minimized and it is effective in view of energy saving or in downsizing devices.

A lubricant holding member 95 has a felt (Nomex, produced by E.I. du Pont de Nemours & Company (Inc.)) having a thickness of about 1 mm to 5 mm impregnated with nonvolatile oil such as a dimethyl silicone oil (KF 96 series produced by Shin-Etsu Chemical Co., Ltd.) having the viscosity of 10 cs to 10000 cs. The nonvolatile oil is applied on the inner surface of the belt 92 in order to increase the slide characteristic between the belt 92 and the pressure pad 94. However, the present invention is not limited to the above; soft nonwoven webs made of aramid or PET which have heat resistance may also be used. A detailed description of the lubricant holding member 95 will be described below with reference to FIG. 4.

A steering roller 96 which acts as an rocking member for suspending the belt 92 from the inner side, has a cylindrical member composed of Fe, Al, and SUS, and the cylindrical member is covered with an elastic layer of about 0.5 mm to 2.0 mm thick and made of silicone rubber. The steering roller 96, as will be described in detail below, is displaced under the control of the CPU (controlling device) according to an output from a belt position detection sensor 921, and functions to rock the belt in the widthwise direction.

Figure 3:
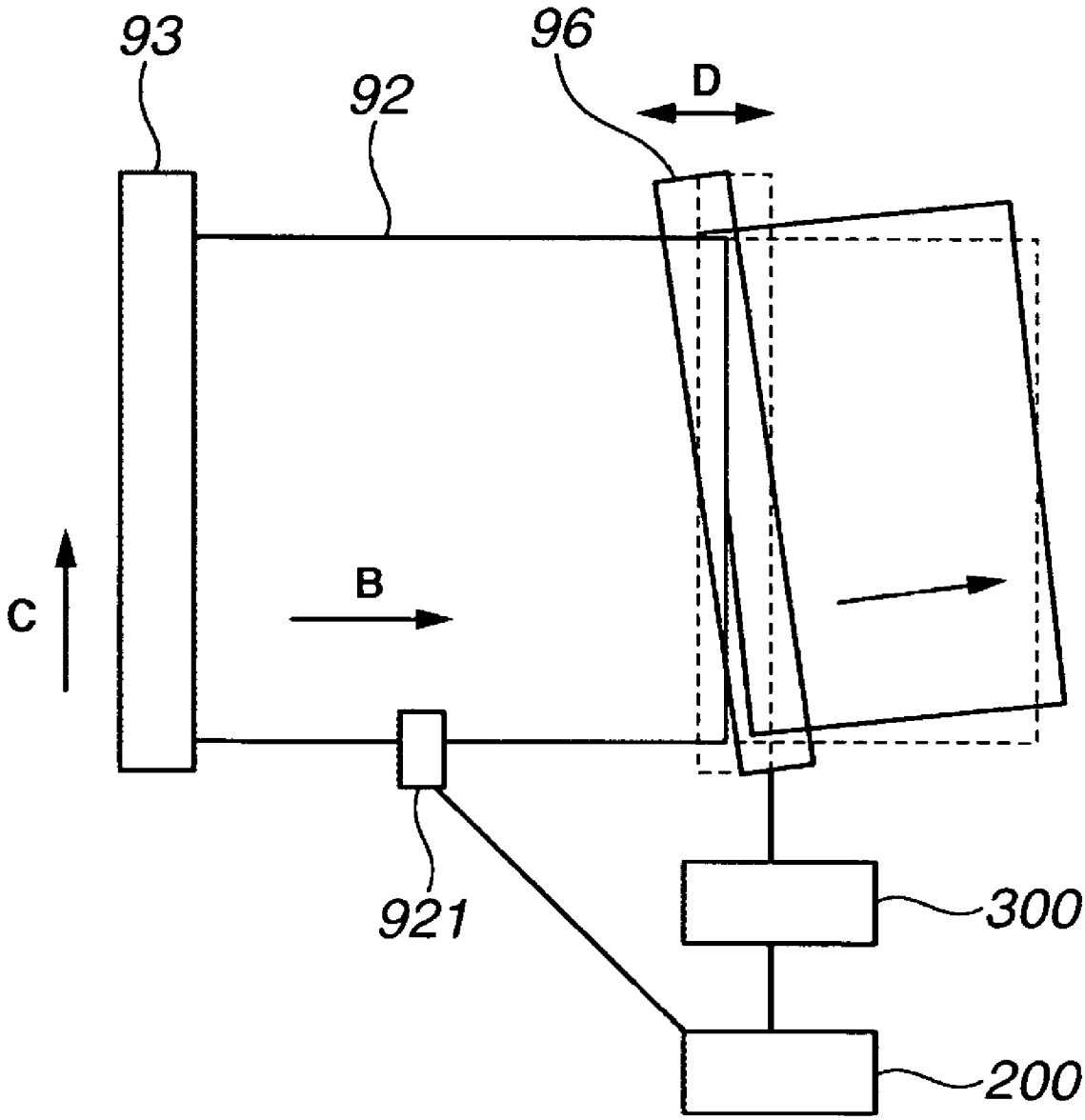
FIG. 3 is an illustration to explain rocking control according to an exemplary embodiment of the present invention.

FIG. 3 illustrates the belt 92 viewed from above to explain the control of belt rocking by the steering roller 96. For example, the belt position detection sensor 921 detects that the belt 92 which rotates and moves in the direction of the arrow B is misaligned in the downward direction as viewed in FIG. 3. Then, the CPU receives a signal from the sensor 921 and generates a signal to a driving mechanism 300 to displace the steering roller 96 from the position shown by a dotted line to the position shown by a solid line (in the direction of the arrow D). That is, the CPU 200 calculates a change in displacement and/or a tilt of the steering roller 96 according to the position of the belt 92 in the widthwise direction C. Then, the belt 92 is in a skew relation with the steering roller 96 in the moving direction B. Accordingly, the position of the belt 92 in the widthwise direction C is corrected in the upward direction in FIG. 3 by the frictional force arising between the belt 92 and the elastic layer of the surface of the steering roller 96. On the other hand, if the belt 92 is misaligned in the upward direction in FIG. 3, the position of the belt 92 in the widthwise direction C is corrected in the downward direction in FIG. 3 by displacing the steering roller 96 in the opposite direction to the above example. As described above, in the exemplary embodiment, the belt 92 is repeatedly actively swung in the widthwise direction by repeatedly displacing the steering roller 96. By control of the rocking of belt 92, it is possible to prevent belt 92 from falling off from the suspension rollers and prevent the end portion in the widthwise direction of the belt 92 from being damaged.

Figure 4:
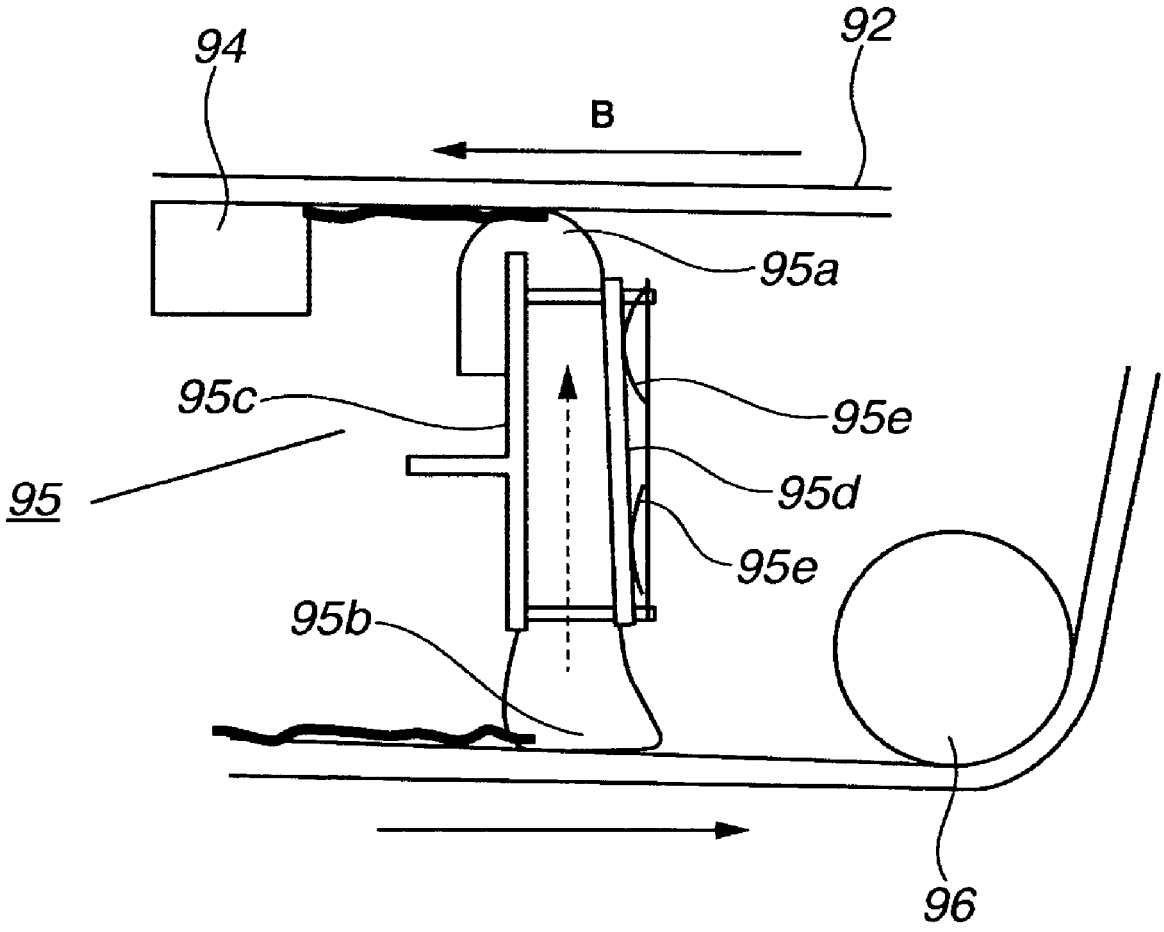
FIG. 4 illustrates a cross-sectional view of the vicinity of a lubricant holding member according to an exemplary embodiment of the present invention.

FIG. 4 is a schematically enlarged view illustrating the relation between the lubricant holding member 95 and the belt 92. The lubricant holding member 95 includes a lubricant applying portion 95*a* and a lubricant collecting portion 95*b*. The lubricant applying portion 95*a* is arranged downstream of the steering roller 96 and upstream of the pressure pad 94 in a moving and rotating direction B of the belt 92 and arranged to contact with the inner surface of the belt 92.

In the exemplary embodiment, the lubricant applying portion 95*a* and the lubricant collecting portion 95*b* are integrally structured. That is, both of the lubricant applying portion 95*a* and the lubricant collecting portion 95*b* are attached to the attaching base 95*c*. The felt of the lubricant holding member 95 is arranged so as to be held between the attaching base 95*c*, and the pressure board 95*d*, and the attaching base 95*c* is screwed to the pad base 94*a* (see FIG. 2). The felt is pressed between the pressure board 95*d* and the attaching base 95*c* by leaf springs 95*e* serving as an urging member. The pressures of the leaf springs are adjusted so as to increase the pressure upwardly in FIG. 4, that is, in the direction of the lubricant applying portion 95*a*. Thus, a fiber density of the felt is set so as to increase in the direction of the lubricant applying portion 95*a* in the exemplary embodiment.

The felt portion which is to be the lubricant applying portion 95*a*, is attached such that the felt portion is folded over the end of the attaching base 95*c*, and fixed to the plane on the opposite side of the attaching base 95*c* with a fixing screw (not shown). The folded over portion of the felt contacts with the inner surface of the belt 92. Accordingly, the fiber density of the felt portion of the lubricant applying portion 95*a* becomes 0.25 to 0.35 g/cm$^3$, and is set to be higher than the felt portion that serves as the lubricant collecting portion 95*b*. Since the top portion (in FIG. 4) of the folded over felt portion is placed on the extension line of the fixing nip and the suspension roller 97, the top portion contacts with the inner surface of the belt 92 with stability irrespective of the motion of the belt 92, and applies the lubricant onto the inner surface of the belt 92.

With the structure according to the exemplary embodiment, the lubricant can be applied onto the inner surface of the belt 92 with stability over the long run, the increase of the friction force between the low-friction sheet and the inner surface of the belt 92 can be reduced, and the load necessary for driving the belt can be maintained small with stability for the long term. Accordingly, it is possible to resolve problems such as a slip or a jam of the recording material P accompanied with an increase of load for driving the belt, image displacement, or the like. Further, wear of the low-friction sheet can be decreased, and, the life of the fixing device can be increased.

The felt portion that serves as the lubricant collecting portion 95*b* differs from that of the lubricant applying portion 95*a*. In this portion, the felt is not sandwitched by the attaching base 95*c* or the pressure board 95*d*. Accordingly, the fiber density of the felt portion of the lubricant collecting portion 95*b* becomes low, namely, 0.15 to 0.25 g/cm$^3$, which is lower than the lubricant applying portion 95*a*. That is, the felt portion that serves as the lubricant collecting portion 95*b*, softly contacts with the inner surface of the belt 92. Further, since the felt portion 95*b* contacts the belt 92 freely in a non-binding state, even if the belt 92 rocks in the widthwise direction due to the steering roller 96, the felt portion 95*b* can appropriately follow the motion of the belt 92. Therefore, the felt can keep contacting with the inner surface of the belt 92 with stability. If there is concern that a large displacement amount of the steering roller 96 may cause and the motion of the belt 92 performed by the rocking control to become unstable, a regulating board may be provided so that the felt tip of the lubricant collecting portion 95*b* follows the motion according to displacement of the steering roller 96.

Since the elastic layer provided on the surface of the steering roller 96 contacts with the inner surface of the belt 92, the belt 92 is moved in the widthwise direction by the friction force. Accordingly, by providing the lubricant collecting portion 95*b*, the amount of an oil film adhering to the surface of the steering roller 96 can be reduced. That is, a decrease in the friction force between the steering roller 96 and the inner surface of the belt 92 can be prevented. Therefore, a fixing device can be provided which satisfies both conditions, which are in a relation of trade-off with each other, namely, stable application of a lubricant onto the inner surface of a belt over the long term, and stable rocking control of a belt over the long term.

Further, as shown in the exemplary embodiment, by providing the difference in the fiber density of the felt between the lubricant collecting portion 95*b* and the lubricant applying portion 95*a*, the dimethyl silicone oil which may serve as a liquid lubricant, moves in a direction of a dotted arrow shown in FIG. 4 due to an capillary phenomenon. Therefore, the lubricant applying portion 95*a* can reapply again the lubricant collected at the lubricant collecting portion 95*b* onto the inner surface of the belt, and the reuse of the collected lubricant becomes possible. Accordingly, the high amount of lubricant with which the felt has to be impregnated in advance can be avoided. As a result, an applying amount of the lubricant can remain adequate with stability from the beginning of the use of the device to the later stage of the use. Further, since it is possible to reduce the impregnation amount of the lubricant, the cost can also be reduced.

In the exemplary embodiment, the lubricant applying portion 95*a* and the lubricant collecting portion 95*b* having different fiber densities are combined and integrally formed in the lubricant holding member 95. However, the present invention is not limited to the exemplary embodiment. For example, only the lubricant applying portion may be provided in the lubricant holding member 95, or as separate members, a lubricant collecting member and a collected lubricant storing portion may be provided. As described in the above exemplary embodiment, in the case of recycling the lubricant, it is preferable to provide a replenish mechanism for sequentially replenishing the used lubricant from the collected lubricant storing portion to the lubricant applying portion. Further, one may also separately provide a storing portion that stores fresh lubricant for replenishment. Thus, a replenish mechanism can be provided in which the lubricant is sequentially replenished from the storing portion for replenishment to the lubricant applying portion. The image heating device according to the present invention is not limited to the above described fixing device, but may also be applied, for example, to a glossiness increasing device. The glossiness increasing device reheats an image fixed on a recording material by the fixing device in order to increase the glossiness of the image. Further, the present invention is not limited to the above described embodiment and the structures of each member may be modified as deemed appropriate provided that it satisfies the both conditions, which are in a relation of trade-off; (1) stable application of a lubricant onto the inner surface of a belt over the long term, and (2) stable rocking control of a belt over the long term.

While the present invention has been described with reference to exemplary embodiments, it is to be understood that the invention is not limited to the disclosed exemplary embodiments.

This application claims priority from Japanese Patent Application No. 2005-134115 filed May 2, 2005, which is hereby incorporated by reference herein in its entirety.

What is claimed is:

1. An image heating device comprising:

a heating rotator configured to heat an image on a recording material at a nip portion;

an endless belt configured to form the nip portion with the heating rotator;

a pressure pad configured to press an inner surface of the endless belt to urge the endless belt toward the heating rotator at the nip portion;

a rocking member configured to contact with the inner surface of the endless belt so as to rock the endless belt in a widthwise direction of the endless belt;

a supplying unit configured to supply a lubricant onto the inner surface of the endless belt at a position downstream of the rocking member and upstream of the pressure pad in a rotating direction of the endless belt; and a collection unit configured to collect the lubricant from the inner surface of the endless belt at a position downstream of the pressure pad and upstream of the rocking member in the rotating direction of the belt, wherein the collection unit re-supplies the lubricant collected by the collection unit to the supplying unit.

2. An image heating device comprising:

a heating rotator configured to heat an image on a recording material at a nip portion;

an endless belt configured to form the nip portion with the heating rotator;

a pressure pad configured to press an inner surface of the endless belt to urge the endless belt toward the heating rotator at the nip portion;

a rocking member configured to contact with the inner surface of the endless belt so as to rock the endless belt in a widthwise direction of the endless belt;

a supplying unit configured to supply a lubricant onto the inner surface of the endless belt at a position downstream of the rocking member and upstream of the pressure pad in a rotating direction of the endless belt; and a collection unit configured to collect the lubricant from the inner surface of the endless belt at a position downstream of the pressure pad and upstream of the rocking member in the rotating direction of the belt, wherein the supplying unit and the collection unit are integrally composed with a single fiber material, and the fiber density of the single fiber material in a lubricant collecting region is lower than the fiber density of the single fiber material in a lubricant supplying region.

3. The image heating device according to claim 1, wherein the supplying unit and the collection unit are integrally composed with a single fiber material, and the fiber density of the single fiber material in a lubricant collecting region is lower than the fiber density of the single fiber material in a lubricant supplying region.

4. The image heating device according to claim 1, wherein the rocking member is a roller having an elastic layer on the outer surface of the roller.

* * * * *